United States Patent [19]

Maher et al.

[11] Patent Number: 4,458,415

[45] Date of Patent: Jul. 10, 1984

[54] HAMMER DRIVEN CHOPPER

[76] Inventors: Eugene Maher, c/o George Spector, 3615 Woolworth Bldg., 233 Broadway; George Spector, c/o Eugene Maher, 3615 Woolworth Bldg., 233 Broadway, both of New York, N.Y. 10007

[21] Appl. No.: 399,322

[22] Filed: Jul. 19, 1982

[51] Int. Cl.[3] ..... B02C 18/00

[52] U.S. Cl. ..... 30/164.6; 30/277; 81/463; 173/101

[58] Field of Search ..... 81/463; 173/100, 101, 173/102, 103; 30/277, 164.6

[56] References Cited

U.S. PATENT DOCUMENTS

| | | | |
|---|---|---|---|
| 2,475,041 | 7/1949 | Mattson | 81/463 |
| 2,754,585 | 7/1956 | Green | 81/463 |
| 2,998,087 | 8/1961 | Iddings | 173/102 |

FOREIGN PATENT DOCUMENTS

| | | | |
|---|---|---|---|
| 392207 | 1/1974 | U.S.S.R. | 173/102 |

*Primary Examiner*—James L. Jones, Jr.

[57] ABSTRACT

A chopping hand tool, including a slidable hammer along a handle of the tool for striking against a hammer stop mounted on the handle, so to transmit the hammer striking force to a toothed edge of a blade affixed to one end of the handle, so that the toothed edge is used to chip materials against which it is applied.

2 Claims, 4 Drawing Figures

HAMMER DRIVEN CHOPPER

This invention relates generally to hand operated tools that are operated by being reciprocally pounded against a work for accomplishing some particular task. More specifically it relates to tools such as choppers used for chopping ice or cutting through asphalt, tools for stripping worn shingles from a roof, installing lawn edging around a garden, and the like.

It is well known that many tools used for such tasks are generally held in one hand for applying against the work, while a hammer is held in the other hand for striking against the tool. In this method of operation, there is always the danger of the hammer missing the tool and striking the persons hand or the work directly, so that this situation is accordingly in need of an improvement.

Accordingly, it is a principal object of the present invention, to provide a hammer driven tool wherein the hammer is permanently installed on the tool so that the hammer cannot strike the tool inaccurately nor accidently strike a hand holding the tool.

Another object is to provide a hammer driven tool wherein the above described principles of the invention, adaptable to numerous types of hand held tools are herein made adaptable particularly to a long handles chopper having a toothed blade for chopping ice from walks and driveways, or other chopping purposes.

Yet another object is to provide a hammer driven chopper that is easy to opeate and requiring less attention to the pounding operation so that more attention may be given to the chopping action on the work itself.

Figure 1:
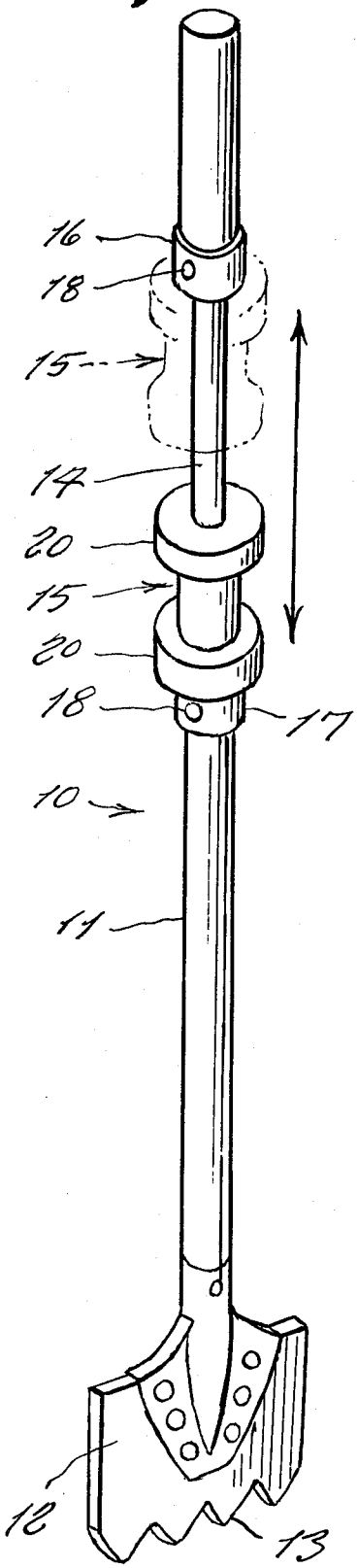
FIG. 1 is a perspective view of the invention.
Figure 2:
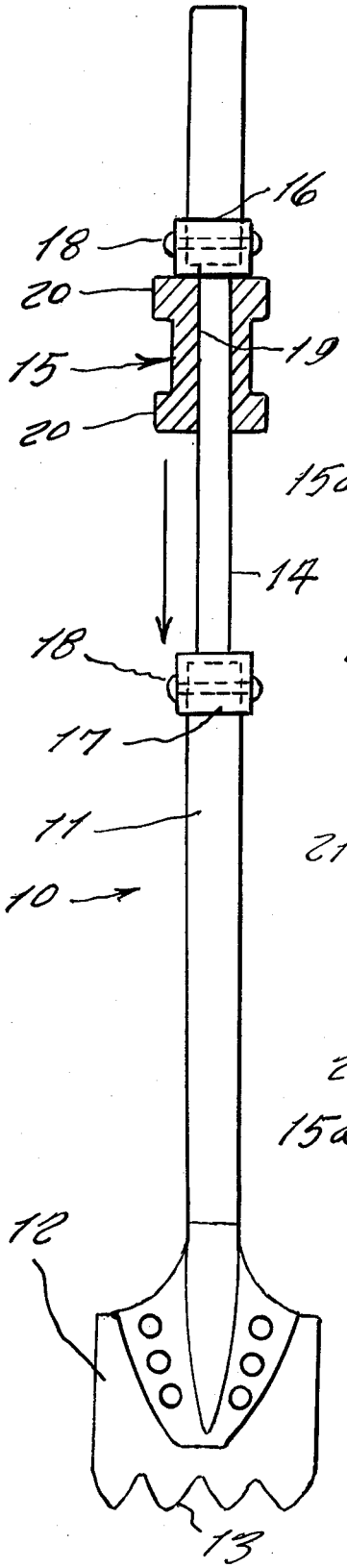
FIG. 2 is a side view thereof and showing the slidable hammer in cross section.

Referring now to the drawing in greater detail, and more particularly to FIGS. 1 and 2 thereof at this time, the reference numeral 10 represents a hammer driven chopper according to the present invention, wherein there is a long handle 11 attached at one end to a flat blade 12 having a toothed edge 13. A portion 14 of the handle has a slidable weight supported therearound so to serve as a hammer 15 for striking against upper and lower hammer stops 16 and 17 at opposite ends of the handle portion 14. Each of the hammer stops comprises a metal ferrsile secured by a cross rivet 18 to the handle in order to withstand the pounding force of the hammer.

The hammer includes a central opening 19 through which the handle portion 14 extends. A wide upper end and lower end flange 20 serve to prevent a persons hand, holding around the hammer, from slipping off the end of the hammer and getting crushed between the end of the hammer and the hammer stop, while pounding the tool.

In operative use, the pounding force of the hammer against the lower hammer stop is transmitted to the cutting edge of the blade 12.

Figure 3:
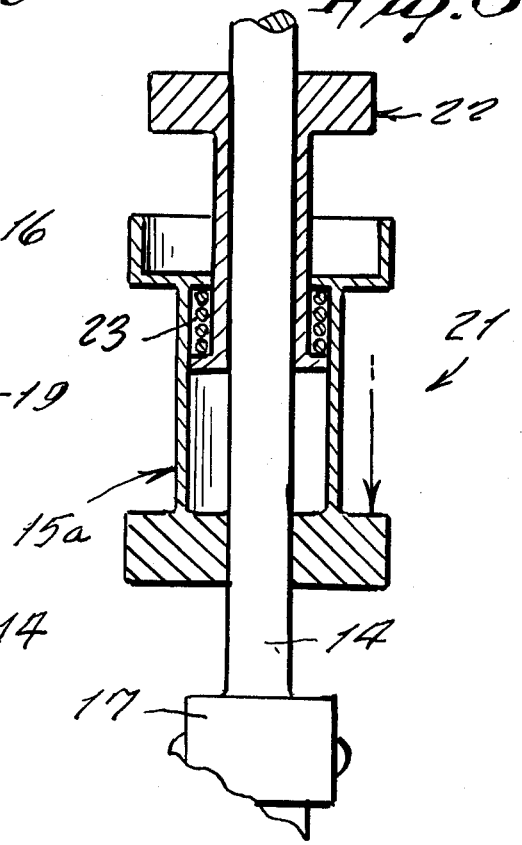
FIG. 3 is a side cross sectional view of another design of the slidable hammer which produces two strikes against the lower anvile or hammer stop at each downward thrust, instead of a single strike, the slidable hammer being shown at a start of its downward thrust.
Figure 4:
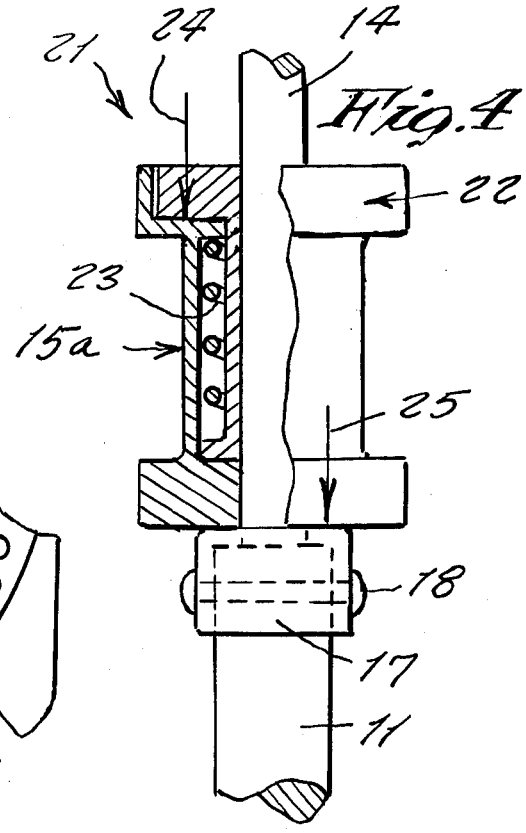
FIG. 4 is a similar view thereof, shown after the both strikes are applied to the lower anvil.

In a modified design 21 of the invention, shown in FIGS. 3 and 4, a hammer **15*a* is made to produce two striking blows against a work at each single downward drop of the hammer, instead of only a single striking blow. This is accomplished by an auxiliary hammer 22 carried by the hammer 15*a* and which is normally supported in a floating position thereupon by means of a compression coil spring 23** therebetween.

In operative use, when the hammer **15*a* strikes the lower hammer stop and comes to a sudden halt, the momentum force of the downwardly carried auxiliary hammer causes the spring to contract so that the auxiliary hammer strikes the stopped hammer 15*a* with force, so to produce a second blow to the work at each single downward drop of the hammer 15*a*, the force of the second blow being transmitted through the stopped hammer 15*a* and to the cutting edge of the tool blade, as indicated by arrows 24 and 25 of FIG. 4**.

While various changes may be made in the detail construction, it is understood that such changes will be within the spirit and scope of the present invention as is defined by the appended claims.

What is claimed:

1. A hammer driven chopper, comprising in combination, an elongated handle, a blade secured to one end of said handle, a portion along said handle carrying a slidable primary hammer therearound, a hammer stop at each end of said handle portion against which said hammer strikes when slid along said handle portion, and means whereby two blows of said hammer are applied to a lower of said hammer stops at each downward drop of said hammer wherein said means comprises an auxiliary hammer carried by the first said hammer, said auxiliary hammer comprising a cylinder slidable about said handle, said cylinder slidably retained within the first said hammer including a spring urging said cylinder outward of the first said hammer including a striking inner portion of the auxiliary hammer adapted to strike an opposing portion of the first said hammer after the first said hammer strikes the hammer stop.

2. A device as in claim 1 wherein the auxiliary hammer is slidably nested in the first said hammer and includes an outer flange which fits within an outer enlarged hollow flange of the first said hammer and said flanges having opposing transverse engaging surfaces.

* * * * *